US009053655B2

(12) United States Patent
Hori

(10) Patent No.: US 9,053,655 B2
(45) Date of Patent: Jun. 9, 2015

(54) DRIVER OF DISPLAY UNIT

(75) Inventor: Yoshihiko Hori, Kanagawa (JP)

(73) Assignee: RENESAS ELECTRONICS CORPORATION, Kawasaki-Shi, Kanagawa (JP)

( * ) Notice: Subject to any disclaimer, the term of this patent is extended or adjusted under 35 U.S.C. 154(b) by 1805 days.

(21) Appl. No.: 12/078,935

(22) Filed: Apr. 8, 2008

(65) Prior Publication Data

US 2008/0252631 A1 Oct. 16, 2008

(30) Foreign Application Priority Data

Apr. 11, 2007 (JP) ..... 2007-103824
Mar. 3, 2008 (JP) ..... 2008-052345

(51) Int. Cl.
*G09G 5/00* (2006.01)
*G09G 3/00* (2006.01)
*G09G 3/20* (2006.01)

(52) U.S. Cl.
CPC ..... *G09G 3/006* (2013.01); *G09G 3/20* (2013.01); *G09G 2310/027* (2013.01); *G09G 2310/0275* (2013.01)

(58) Field of Classification Search
USPC ..... 345/208, 89, 98, 55
See application file for complete search history.

(56) References Cited

U.S. PATENT DOCUMENTS 4,380,070 A * 4/1983 Steiner ..... 340/537
2003/0052851 A1* 3/2003 Yano et al. ..... 345/89
2005/0024315 A1* 2/2005 Yamagata et al. ..... 345/98
2006/0044298 A1* 3/2006 Mignard et al. ..... 345/205
2006/0181526 A1 8/2006 Ota
2006/0187225 A1* 8/2006 Ota ..... 345/530
2007/0001939 A1* 1/2007 Hashimoto et al. ..... 345/76
2010/0045329 A1* 2/2010 Staudt et al. ..... 324/763

FOREIGN PATENT DOCUMENTS

JP 10-79653 A 3/1998
JP 2006-53480 2/2006
JP 2006-227168 8/2006

OTHER PUBLICATIONS

Notice of Reasons for Rejection dated Jun. 5, 2012 (with a partial English translation).

* cited by examiner

*Primary Examiner* — William Boddie
*Assistant Examiner* — Leonid Shapiro
(74) *Attorney, Agent, or Firm* — McGinn IP Law Group, PLLC

(57) ABSTRACT

According to one aspect of the present invention, there is provided a driver of a display unit including a latch circuit holding gradation information, a D/A converter outputting analog signal based on the gradation information held by the latch circuit, a test circuit provided between the latch circuit and the D/A converter, the test circuit inputting or outputting test signal regarding the latch circuit, a switch connecting voltage output of the D/A converter and a driver output terminal in normal operation, and a test switch connecting the test circuit and the driver output terminal in test operation and disconnecting the test circuit and the driver output terminal in normal operation.

10 Claims, 12 Drawing Sheets

| TB0 | TB1 | TB2 | TEST SIGNAL |
|---|---|---|---|
| 0 | 0 | 0 | DB0 |
| 0 | 0 | 1 | DB1 |
| 0 | 1 | 0 | DB2 |
| 0 | 1 | 1 | DB3 |
| 1 | 0 | 0 | DB4 |
| 1 | 0 | 1 | DB5 |
| 1 | 1 | 0 | DB6 |
| 1 | 1 | 1 | DB7 |

DRIVER OF DISPLAY UNIT

BACKGROUND OF THE INVENTION

1. Field of the Invention

The present invention relates to a driver of a display unit such as a liquid crystal display, an organic light emitting display, a plasma display or the like. More particularly, the present invention relates to a driver such as a column driver, a source driver, or a horizontal driver or the like.

2. Description of Related Art

A display unit has recently become larger and larger in size due to development of manufacturing technique. The display unit having large size requires ability of driving large capacitance load of output of the driver. It means that output impedance of the driver needs to be decreased. If the output impedance is not substantially small, there is caused a problem such as lack of driving ability, increase of power consumption, or heat generation.

Further, recent display unit performs multi-gradation display, and there is developed a multi-bit driver of the display unit. Moreover, the driver of typical display unit has hundreds of driving outputs and includes latch circuits, level shifters, D/A converters, and buffer amplifiers.

FIG. 13 shows an example of a driving output circuit in the driver of the display unit according to a related art.

The driver shown in FIG. 13 is an output circuit having two outputs. A driver 10 of the display unit includes a latch circuit 11, a level shifter 12, a D/A converter 13, an output amplifier 15, an output switch 16, and an output pin 17. In this example, it is assumed that the display unit is a liquid crystal display and includes a polarity switching circuit 14 and the output switch 16. In this example, the polarity switching circuit 14 is provided between the D/A converter 13 and the output amplifier 15. However, the polarity switching circuit may be provided between the output amplifier 15 and the output pin 17. In this case, the polarity switching circuit may also function as the output switch.

Hereinafter, a behavior of the driver of the display unit shown in FIG. 13 will be described in brief. The latch circuit 11 holds digital gradation information for each driving output and outputs the digital gradation information to the level shifter 12 as the output signal. The level shifter 12 performs voltage level conversion between the latch circuit 11 which is a low voltage circuit and the D/A converter 13 which is a high voltage circuit. The digital gradation information output from the level shifter 12 is converted into gradation information signal having analog value by the D/A converter 13 according to its digital value. The gradation information signal having analog value that is output from the D/A converter 13 is alternately switched by the polarity switching circuit 14 in a predetermined cycle and input to the output amplifier 15. The output amplifier 15 amplifies the analog gradation information signal and outputs the amplified signal to the output pin 17 when the output switch 16 is in ON state.

In the multi-bit driver as stated above, the test may take longer time and accuracy is not high. In order to overcome these problems, Japanese Unexamined Patent Application Publication No. 2006-227168 discloses a technique to provide a driver of a display unit in which inspection time is reduced and inspection accuracy is improved.

In the prior art disclosed in Japanese Unexamined Patent Application Publication No. 2006-227168, the driver includes a selector selecting output of the latch circuit to output latch data from a predetermined bit, and an output selector switching a level shifter output corresponding to the predetermined bit and gradation voltage output. In normal operations, the selector is switched so as to output the gradation voltage to the driving output pin. In test operations, the selector is switched so as to output voltage (test output voltage) according to the level shifter output corresponding to the predetermined bit.

As stated above, the display unit having large size requires ability of driving large capacitance load of output of the driver. If the output impedance of the driver is not substantially small, there is caused a problem such as lack of driving ability, increase of power consumption, or heat generation.

In the prior art as in Japanese Unexamined Patent Application Publication No. 2006-227168, there is provided an output selector where gradation voltage is output to the driving output pin of the driver in the normal operation and test output voltage is output in the test operation. This output selector needs to be composed of the transistor since the output selector is implemented in the integrated circuit. The switch made of transistor has impedance in accordance with its size. Therefore, if the transistor having lower impedance is employed in order to maintain large driving ability, the size of the integrated circuit composing the selector increases. On the other hand, if the selector is composed of small transistor in order to avoid increase in size, the output impedance increases and the ability of driving the output load is lacked. Further, if the driving ability of the amplifier is enhanced in order to compensate lack of driving ability, there are caused other problems such as increase in power consumption and heat generation.

Therefore, there is a need to connect the driving output pin and the test signal without directly adding the selector which is one of factors for increasing impedance to the driving output pin which requires driving ability.

There is Japanese Unexamined Patent Application Publication No. 2006-053480 as a prior art.

SUMMARY

According to one aspect of the present invention, there is provided a driver of a display unit including a latch circuit holding gradation information, a D/A converter outputting analog signal based on the gradation information held by the latch circuit, a test circuit provided between the latch circuit and the D/A converter, the test circuit inputting or outputting test signal regarding the latch circuit, a switch connecting voltage output of the D/A converter and a driver output terminal in normal operation, and a test switch connecting the test circuit and the driver output terminal in test operation and disconnecting the test circuit and the driver output terminal in normal operation.

According to the driver of the display unit of the present invention, it is possible to output test result of an internal circuit from the output terminal of the driver and to input test signal to the output terminal of the driver with little or no change of output performance of the driver of the display unit.

According to the driver of the display unit of the present invention, it is possible to perform test without substantially degrading performance of the driver. Therefore, the test can be carried out in easier manner, and both of test time and test cost can be reduced.

BRIEF DESCRIPTION OF THE DRAWINGS

The above and other objects, advantages and features of the present invention will be more apparent from the following description of certain preferred embodiments taken in conjunction with the accompanying drawings, in which.

DETAILED DESCRIPTION OF THE PREFERRED EMBODIMENTS

The invention will now be described herein with reference to illustrative embodiments. Those skilled in the art will recognize that many alternative embodiments can be accomplished using the teachings of the present invention and that the invention is not limited to the embodiments illustrated for explanatory purposes.

First Embodiment

Hereinafter, the first specific embodiment to which the present invention is applied will be described in detail with reference to the drawings. In the first embodiment, the present invention is applied to a driver of a display unit.

Figure 1:
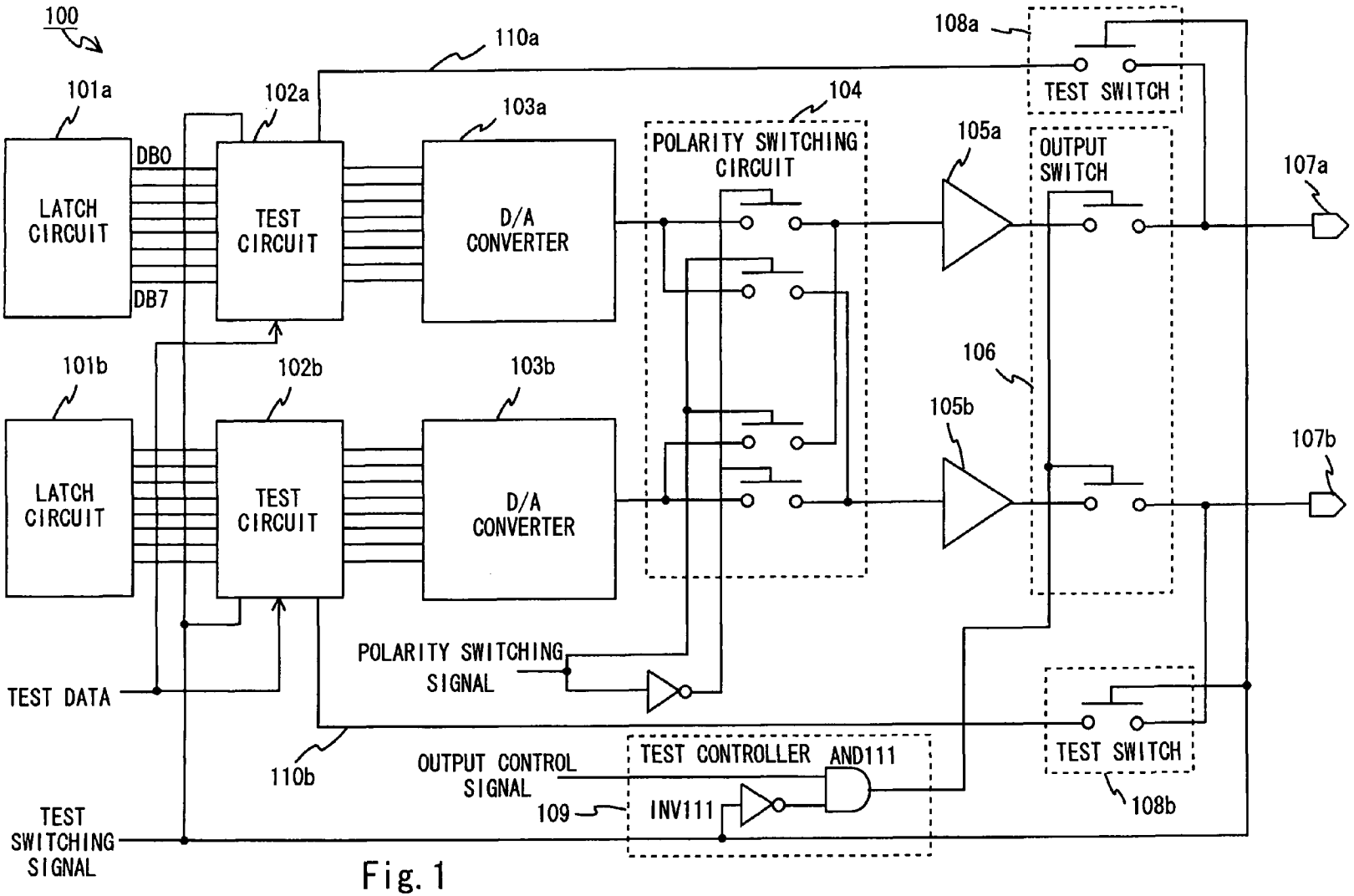
FIG. 1 shows an example of a configuration of a driver of a display unit according to a first embodiment of the present invention.

FIG. 1 shows an example of a configuration of the driver of the display unit according to the first embodiment of the present invention. Note that the driver shown in FIG. 1 is applied to a liquid crystal display as a display unit. FIG. 1 shows an example of an output circuit having only two outputs for the sake of simplicity.

The driver 100 includes a latch circuit 101, a test circuit 102, a D/A converter 103, a polarity switching circuit 104, an output amplifier 105, an output switch 106, an output pin 107, a test switch 108, a test controller 109, and a test signal line 110. As stated above, the driver 100 of the first embodiment has two outputs. Therefore, symbol of a or b is given to each signal of the configuration as necessary to make a distinction.

The latch circuit 101 holds digital gradation information for each driving output and outputs the digital gradation information to the test circuit 102 as output signals. The output signals of the digital gradation information are input to the test circuit 102 through data buses DB0 to DB7.

The test circuit 102 tests the output signals of the latch circuit 101 and is connected to the test signal line 110. The test circuit 102 performs normal operation when the test switching signal is in low level and directly outputs the signals from the latch circuit 101 to the D/A converter 103. The test circuit 102 performs test operation when the test switching signal is in high level and outputs the test signal which is the test information of the output signals of the latch circuit 101 to the test signal line 110. The test signal of the test circuit 102 is determined by the configuration of the test circuit 102 and the test signal may be either input signal or output signal. The test data controls a behavior of the test circuit 102. This test data is typically input to the driver 100 from a test device (not shown).

The latch circuit 101 and the D/A converter 103 are connected by the data buses DB0 to DB7. The symbol "DB0 to DB7" indicates both of the name of the data bus and the signal (having a value of 0 or 1) output to the data bus for the sake of convenience.

Figure 2:
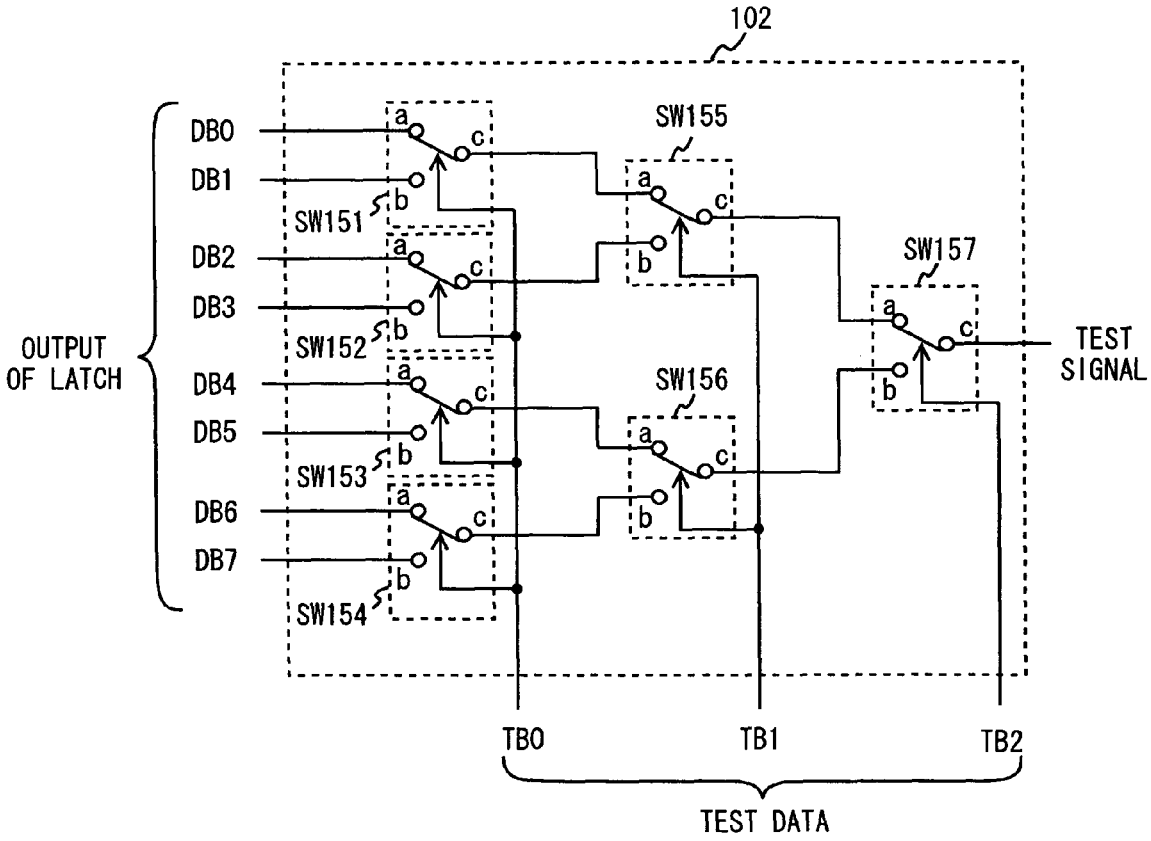
FIG. 2 shows an example of a specific configuration of a test circuit according to the first embodiment of the present invention.

FIG. 2 shows a specific configuration example 1 of the test circuit 102. FIG. 2 only shows a configuration of a part of the test circuit 102 where the test operation is performed for the sake of simplicity. Therefore, although not specifically shown, the test circuit 102 directly outputs the signals from the latch circuit 101 to the D/A converter 103 in normal operation as stated above.

As shown in FIG. 2, the test circuit 102 includes switches SW151 to SW157. Each of the switches SW151 to SW157 has two input terminals a and b and one output terminal c. Eight data buses DB0 to DB7 are connected to first-stage switches SW151 to SW154. For example, the DB0 is connected to the input terminal a of the SW151, and the DB1 is connected to the input terminal b of the SW151. The output terminals of the first-stage switches SW151 to SW154 are further connected to the input terminals of the second-stage switches SW155 and SW156. The output terminals of the second-stage switches SW155 and SW156 are further connected to the third-stage switch SW157. These switches SW151 to SW157 are controlled by the test data TB0 to TB2 so as to connect the output terminal c and the input terminal a or b. For example, when the test data TB0 is 0, which means the test data is in low level, the input terminals a and the output terminals c of the switches SW151 to SW154 are connected. On the other hand, when the test data TB0 is 1, which means the test data is in high level, the input terminals b and the output terminals c are connected. This can also be applied to the test data TB1 and the switches SW155 and SW156, or the test data TB2 and the switch SW157.

Figures 3, 4:
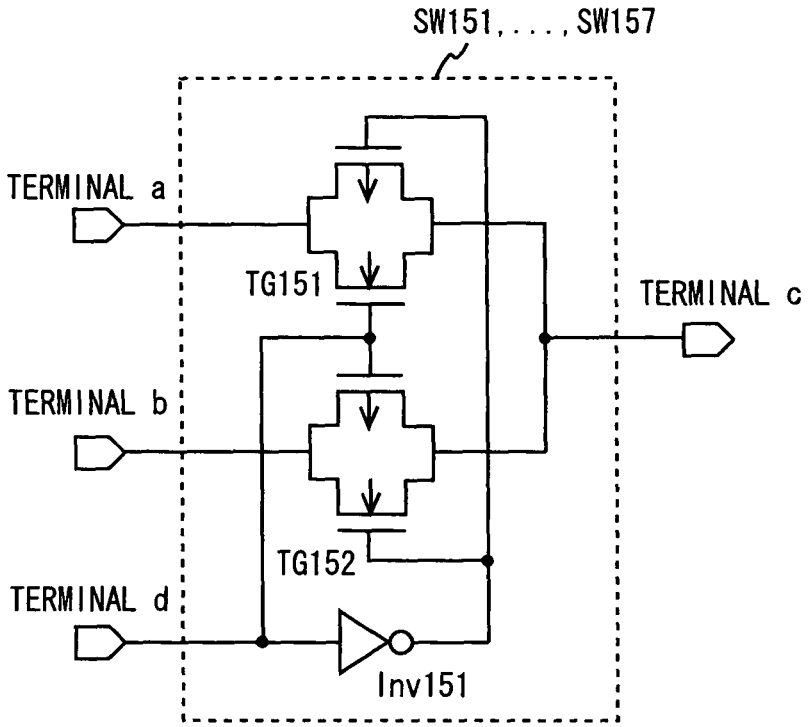
FIG. 3 shows an example of a specific configuration of a switch of the test circuit according to the first embodiment of the present invention.
FIG. 4 is a table showing a relationship between test data and test signal according to the first embodiment of the present invention.

The switches SW151 to SW157 include CMOS transfer gates TG151 and TG152 and an inverter Inv151 as shown in FIG. 3. The transfer gates TG151 and TG152 are connected in parallel, and the input terminal a and the transfer gate TG151 are connected and the input terminal b and the transfer gate TG152 are connected. Both of the outputs of the transfer gates TG151 and 152 are connected to the output terminal c. Further, the test data input terminal d and the input of the inverter Inv151 are connected to each other. One of the transfer gates is exclusively selected by the input signal of the test data input terminal d and the output signal of the inverter Inv151. The input signal to the inverter Inv151 is the test data.

The first-stage switches SW151 to SW154, the second-stage switches SW155 and SW156, and the third switch SW157 are controlled by the test data TB0, TB1, and TB2. Note that each of the test data TB0, TB1, and TB2 is binary signal. As shown in FIG. 4, the test circuit 102 outputs one of the eight signals output from the latch circuit 101 as one of the test signals DB0 to DB7 by eight combinations made of test data TB0 to TB2.

The D/A converter 103 converts the digital signal output from the test circuit 102 into the analog signal to output the analog signal. The analog output signal output from the D/A converter 103*a* or 103*b* is positive voltage output signal or negative voltage output signal. For example, if the D/A converter 103*a* outputs positive voltage output signal, the D/A converter 103*b* outputs negative voltage output signal.

The polarity switching circuit 104 is the switch for inverting polarity of voltage applied between a liquid crystal pixel electrode and a counter electrode in a certain cycle to prevent degradation that is occurred due to the characteristics of the liquid crystal material. Therefore, the positive voltage output of the D/A converter 103*a* and the negative voltage output of the D/A converter 103*b* are switched in a certain cycle by the polarity switching circuit 104 to be output to the output amplifier which is in the later stage.

The output amplifier 105 amplifies the signal from the polarity switching circuit 104 to output the amplified signal to the output switch 106. Note that the output amplifier 105*a* or 105*b* may be for positive voltage or negative voltage.

Figure 5:
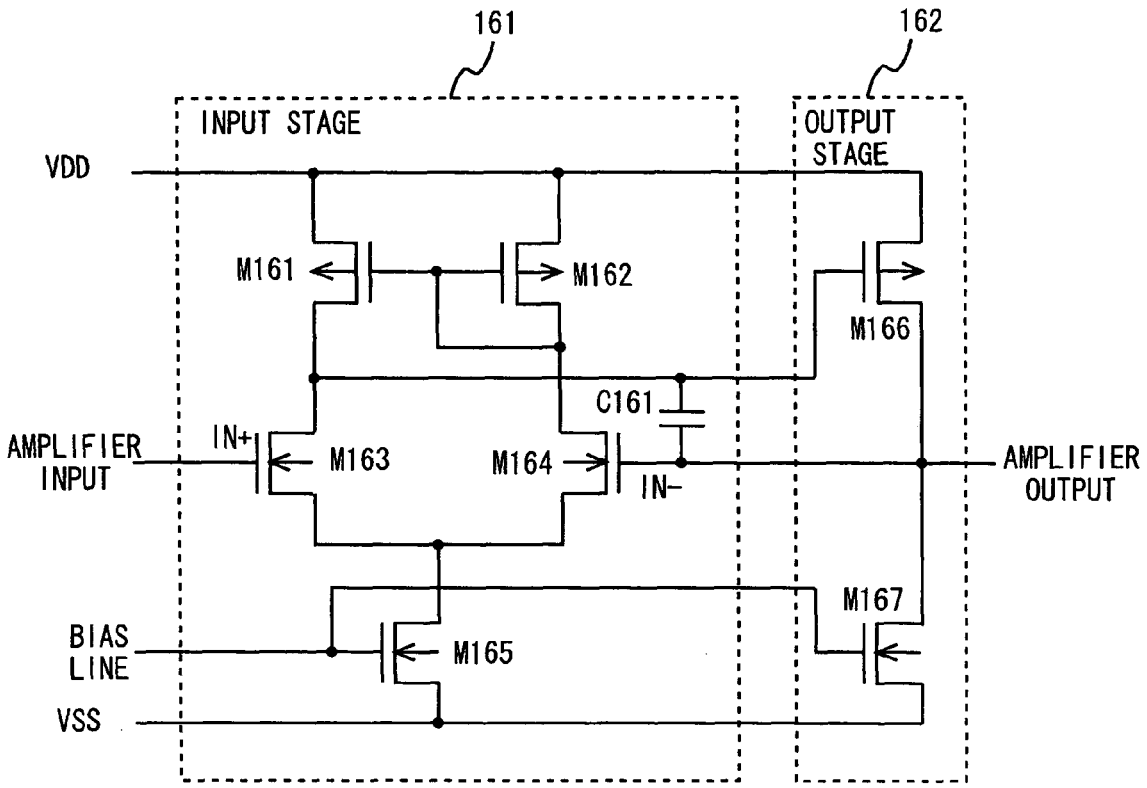
FIG. 5 shows an example of a specific configuration of an output amplifier according to the first embodiment of the present invention.

FIG. 5 shows a specific configuration of the output amplifier 105. As shown in FIG. 5, the output amplifier 105 includes an input stage 161 and an output stage 162. The input stage 161 includes PMOS transistors M161 and M162, NMOS transistors M163 to M165, and a capacitance element C161. The output stage 162 includes a PMOS transistor M166 and an NMOS transistor M167. The input stage 161 forms differential amplifier, and the output of the D/A converter 103*a* or 103*b* is applied to an input IN+ in FIG. 5 through the polarity switching circuit 104. The output of the output stage 162 is applied to an input IN−. Although the output amplifier 105 shown in FIG. 5 has differential input configuration, the output amplifier 105 may be replaced with the amplifier having single-phase input.

The test switch 108 connects the test signal line 110 to the output pin 107 in test operation. The test switch 108 can use CMOS transfer gate, for example.

The output switch 106 is the switch disconnecting the output amplifier 105 and the output pin 107 of the driver. The output switch 106 is connected when the mode is not in test mode (when the test switching signal is in low level) and the output control signal is in high level, and is disconnected when the output control signal is in low level. The output control signal is in high level while the output is driven. Note that connection between panel terminals are shorted out in order to collect charges of panel pixel immediately before the polarity of the data line is inversed. At this time, the output control signal is set to low level and the output switch 106 is turned off. Hence, the output switch 106 also has a function of effectively collecting charges of the panel during this period.

The test controller 109 forces to disconnect the output switch 106 in test operation when there is provided the output switch 106. In the first embodiment, the output switch 106 also needs to be disconnected when the test switching signal is in high level. Therefore, the test controller 109 is formed by an inverter INV 111 inverting the test switching signal and an AND circuit AND 111 to which the output control signal and signal from the inverter INV 111 are input.

In the present invention, the level shifter described in the related art is omitted for simplicity. This is because some test circuits need to have the level shifter between the latch circuit and the test circuit, and other circuits need to have the level shifter between the test circuit and the D/A converter. Such combination is not related to the essential part of the present invention, and therefore the level shifter is not shown in this invention.

Now, the behavior of the driver of the display unit according to the first embodiment will be described. The description of the behaviors of the latch circuit, the D/A converter, the polarity switching circuit, and the output amplifier is omitted since they have already been explained in the related art.

Now, the description will be made on a case where the test switching signal is in low level (normal state). In normal state, the test switching signal is in low level, and therefore the test circuit 102 outputs the signals from the latch circuit 101 directly to the D/A converter 103. At this time, the test switch 108 is in disconnection state. In the normal state, there are output driving period and panel charge collecting period. In the output driving period, the output control signal is in high level and the output switch 106 is in conduction state. Therefore, the output amplifier 105 and the output pin 107 are connected. The rest of the operation is the driver operation which is the same as the operation described in the related art.

In the first embodiment, it is assumed that the test signal is the output signal from the test circuit 102. Because the test switch 108 is disconnected, the test signal output from the test circuit 102 may be either in output state or in high-impedance state. On the other hand, when the test signal is in input state, the test signal may be fixed to high level or low level since the high-impedance state occurred by disconnecting the test switch is not preferable. The test switch may be in connection state if the test circuit is not influenced by the test signal and the test signal does not influence the output pin 107 when the test switching signal is in low level (normal operation). If the test signal of the test circuit 102 has withstand voltage that can withstand gradation voltage output from the output amplifier, the connection state that is stated above may be conduction state. The connection state mentioned here means the state where the signal can be transmitted. The level may be changed in transmission. The conduction state mentioned here means the state connection is made in a relatively low impedance.

Now, the description will be made on a case where the test switching signal is in high level (test state). In the test state, the test switching signal is in high level, and the output of the latch circuit 101 is input to the test circuit 102 and the test circuit 102 performs the test and outputs the test signal to the test signal line 110. At the same time, the output switch 106 is forced to be disconnected by the test controller 109 regardless of the state of the output control signal. The test switch 108 is in connection state at this time. Therefore, the output pin 107 does not output the output gradation voltage from the output amplifier 105 but outputs the test signal. Otherwise, it is possible to input the test control signal from an external device through the output pin 107.

Figure 6:
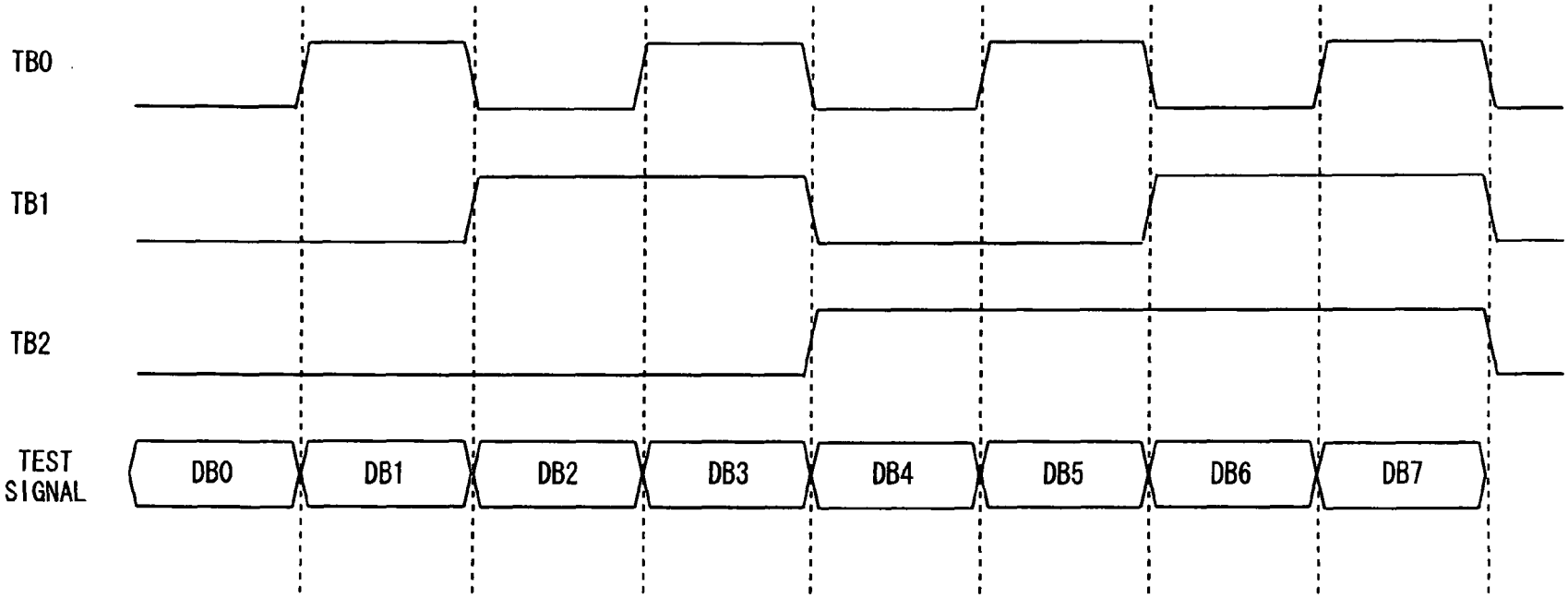
FIG. 6 is a timing chart of a behavior of the test circuit according to the first embodiment of the present invention.

FIG. 6 shows an operation of the specific configuration example 1 of the test circuit 102 shown in FIG. 2. The test data TB0, TB1, and TB2 each controls connection between the input terminal a or b and the output terminal c of the first-stage switches SW151 to SW154, the second-stage switches SW155 and SW156, and the third-stage switch SW157 forming the test circuit 102. We assume here that the input terminal a and the output terminal c are connected when the test data is 0, which means the test data is in low level, and the input terminal b and the output terminal c are connected when the test data is 1, which means the test data is in high level in the switches SW151 to 157.

The test data TB0 repeats binary data of 0 and 1 in predetermined clock cycle. The test data TB1 repeats binary data of 0 and 1 in clock cycle that is twice as long as that in the test data TB0. The test data TB2 repeats binary data of 0 and 1 in clock cycle that is three times as long as that in the test data TB0. The values of the data buses DB0 to DB7 (output data of the latch circuit 101 which is the test target) are sequentially output to the test signal line 110 from the test circuit 102 by periodically changing the test data TB0, TB1, and TB2.

Instead of periodically changing the test data TB0 to TB2, it is also possible to output the values of the data buses DB0 to DB7 to the test signal line 110 by specific bit combination. In this case, the test circuit 102 may specify one of the output data of the latch circuit 101 selected by three bits of test data TB0 to TB2 to output the data as the test signal 110. For example, when all of the test data TB0 to TB2 are 0, the data bus DB0 is output as the test signal.

Figure 7:
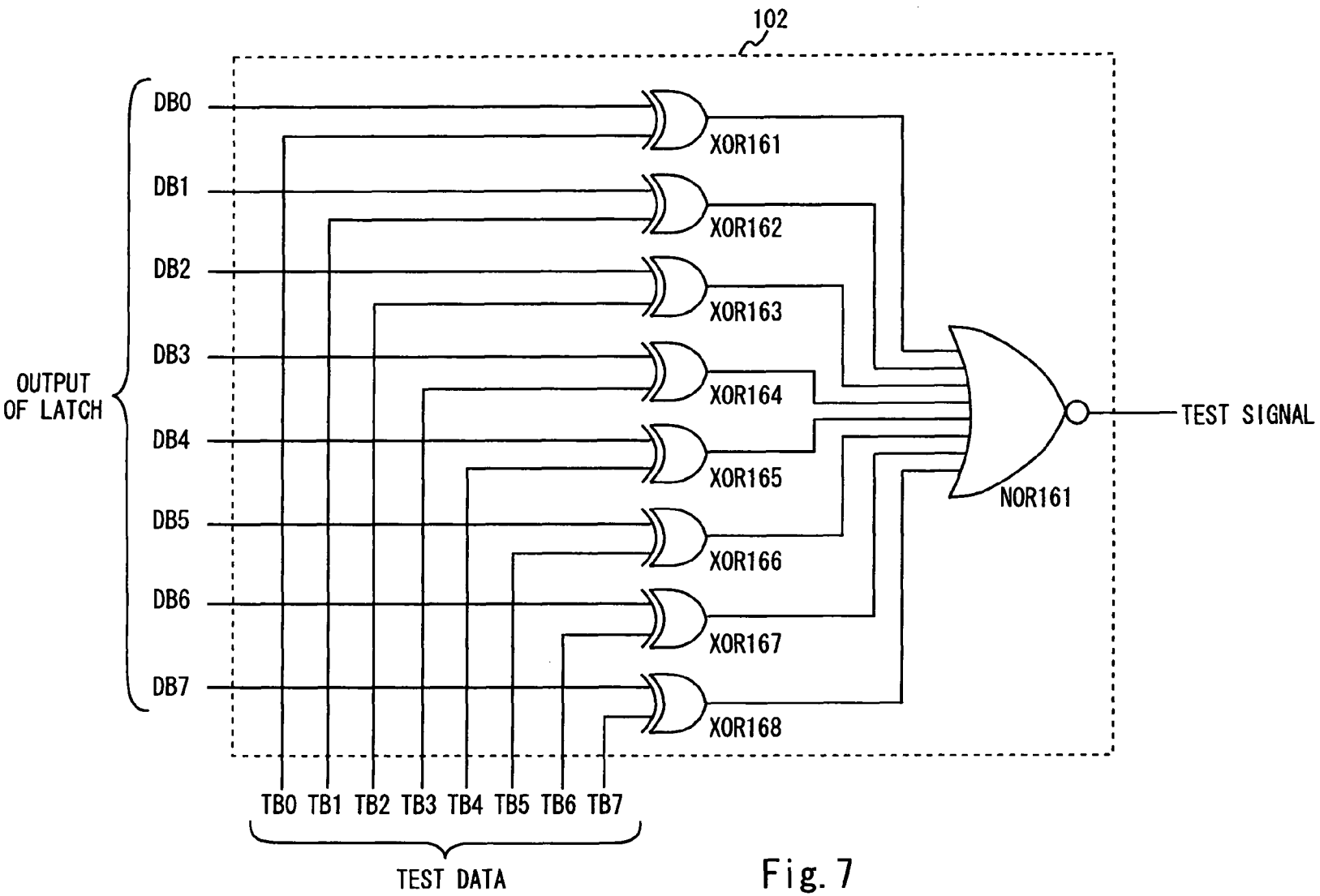
FIG. 7 shows another example of a specific configuration of the test circuit according to the first embodiment of the present invention.

FIG. 7 shows a specific configuration example 2 of the test circuit 102 shown in FIG. 1. The configuration example of the test circuit 102 detects match or mismatch between two sets of 8-bit data. The test circuit 102 of this example includes XOR circuits XOR 161 to 168 and an NOR circuit NOR 161. As shown in FIG. 7, the XOR circuits XOR 161 to 168 have one terminals to which 8-bit data of the latch circuit 101 output to the data buses DB0 to DB7 are input and the other terminals to which the 8-bit test data TB0 to TB7 input to the driver 100 from the test device (not shown) are input. The outputs of the XOR circuits XOR 161 to 168 are input to the NOR circuit NOR 161 and output to the test signal line 110 from the test circuit 102 as the test signal. When the 8-bit data output from the latch circuit 101 (measurement value) and the 8-bit data of the test data (expectation value) completely match, the test circuit 102 outputs the value of "True" and otherwise outputs the value of "False". In the second example, it is possible to reduce test time since 8-bit data is compared in parallel.

The connection between the data buses DB0 to DB7 and the test circuit 102 is controlled by the test switching signal in both test circuits 102 shown in FIGS. 2 and 7. Although the controller is not especially shown in FIGS. 2 and 7, the connection can be realized by providing another switch between the data buses DB0 to DB7 and the input part of the test circuit 102. The switch is closed when the test switching signal is in high level and the switch is opened when the test switching signal is in low level.

In the driver 100 according to the first embodiment, the switch between the output amplifier and the output pin does not influence the driving ability of the driver even when the test circuit is added to the driver. Therefore, there is not caused a problem that the driving ability is lacked due to increase of output impedance. Further, since it is not needed to improve the driving ability of the output amplifier to compensate the lack of the driving ability, there is not caused a problem of increased power consumption or the heat generation.

Second Embodiment

Figure 8:
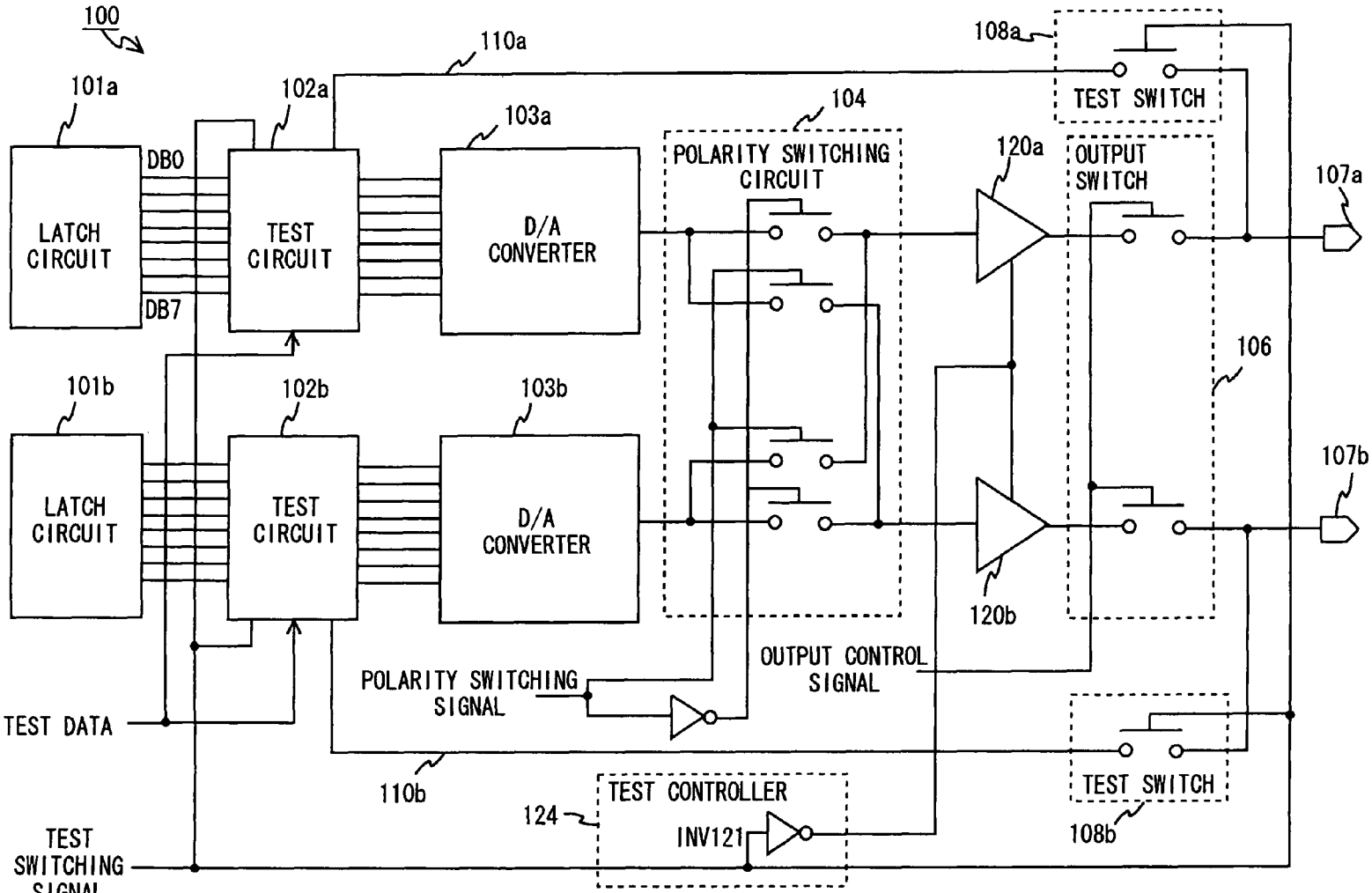
FIG. 8 shows an example of a configuration of a driver of a display unit according to a second embodiment of the present invention.

Hereinafter, the driver of the display unit according to the second embodiment of the present invention will be described with reference to FIG. 8. FIG. 8 shows an example of a configuration of the driver of the display unit according to the second embodiment. The configurations to which the same symbols as in FIG. 1 are given are the same or similar to the configurations in FIG. 1. The difference between the first embodiment and the second embodiment is that the output amplifier has an output enable function in the second embodiment, and there is difference in configurations of the output amplifier 120 and the test controller 124.

The test controller 124 makes the output of the output amplifier 120 high-impedance state in test operation when the output amplifier 120 has the output enable function. In other words, the output stage of the amplifier 120 in test operation is made deactivation state. The test controller 124 is formed by an inverter INV 121 inverting the test switching signal in order to make the output of the amplifier 120 high-impedance state when the test switching signal is in high level (test operation).

Figure 9:
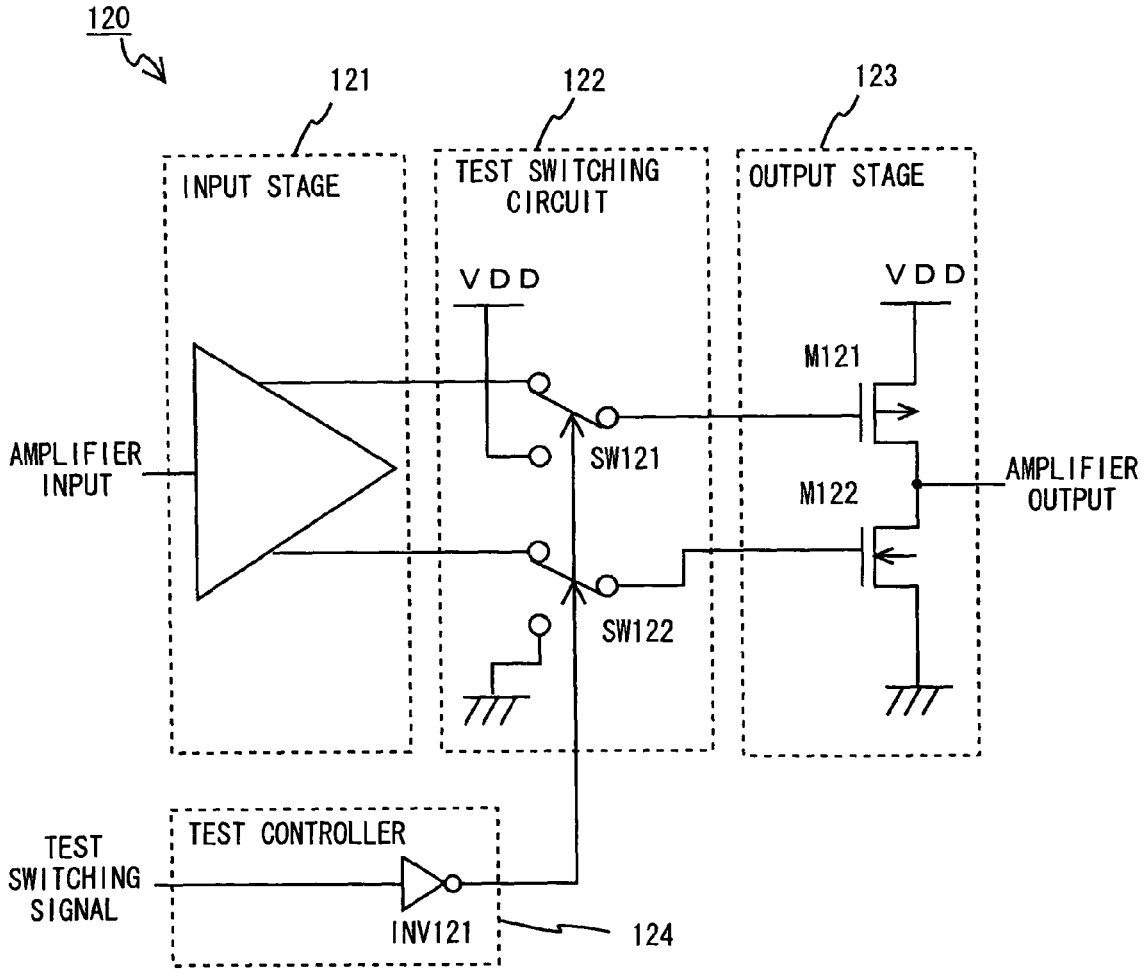
FIG. 9 shows an example of a configuration of an output amplifier of the display unit according to the second embodiment of the present invention.

Now, the amplifier 120 will be described. FIG. 9 shows an example of the amplifier having output enable function. As shown in FIG. 9, the amplifier 120 includes an input stage 121, a test switching circuit 122, and an output stage 123.

The signal from the D/A converter 103 is input to the input stage 121. Note that the specific configuration of the input stage 121 is the same as the configuration of the amplifier input stage 161 shown in FIG. 5.

The test switching circuit 122 includes switches SW121 and SW122. The SW121 switches the signal output from the input stage 121 and VDD voltage, and the SW122 switches the signal output from the input stage 121 and ground voltage according to the test switching signal. The switch SW121 is connected to the output side of the input stage 121 when the test switching signal is in low level and is connected to VDD side when the test switching signal is in high level. Similarly, the switch SW122 is connected to the output side of the input stage 121 when the test switching signal is in low level and is connected to ground when the test switching signal is in high level.

The output stage 123 includes a PMOS transistor M121 and an NMOS transistor M122 in series between VDD and ground. The output from the switch SW121 is input to a gate of the PMOS transistor M121. Similarly, the output from the switch SW122 is input to the gate of the NMOS transistor M122. There is provided an output terminal of the amplifier 120 between the PMOS transistor M121 and the NMOS transistor M122.

Hereinafter, the behavior of the driver of the display unit according to the second embodiment will be described. The description of the configurations other than the amplifier 120 and the test controller 124 are omitted since these configurations are the same as those in the first embodiment. The specific configuration and the description of the behavior of the test circuit 102 are omitted as well.

The test switching signal is in high level and the signal output from the test controller 124 is in low level in test operation. Therefore, the switch SW121 of the test switching circuit 122 is connected to VDD side and the switch SW122 is connected to ground side. Therefore, the high level signal is input to the gate of the PMOS transistor M121 of the output stage 123, and the PMOS transistor M121 is turned off. On the other hand, the low level signal is input to the gate of the NMOS transistor M122 and the NMOS transistor M122 is turned off as well. Therefore, both of the transistors of the output stage 123 are in disconnection state and the amplifier output terminal is in high-impedance state. In other words, the output stage 123 is in deactivation state in test operation. At this time, the test switch 108 is in connection state and the test signal is connected to the output pin 107. Therefore, the output pin 107 can be used as the pin for test signal.

On the other hand, the test switching signal is in low level and the signal output from the test controller 124 is in high level in normal operation. Therefore, the switches SW121 and SW122 of the test switching circuit 122 are connected to the output side of the input stage 121. Therefore, the output signal of the input stage 121 is input to the output stage 123 and the output stage 123 functions as inverter amplifier. The signal from the D/A converter 103 input to the output amplifier 120 is output to the amplifier output terminal with predetermined driving ability. The rest of the operation is the same as in the normal operation of the first embodiment.

In the driver 100 according to the second embodiment, the switch between the output amplifier and the output pin does not influence the driving ability of the driver even when the test circuit is added to the driver as well as in the first embodiment. Therefore, there is not caused a problem that the driving ability is lacked due to increase of output impedance. Further, since it is not needed to improve the driving ability of the output amplifier to compensate the lack of the driving ability, there is not caused a problem of increased power consumption or the heat generation.

Third Embodiment

Figure 10:
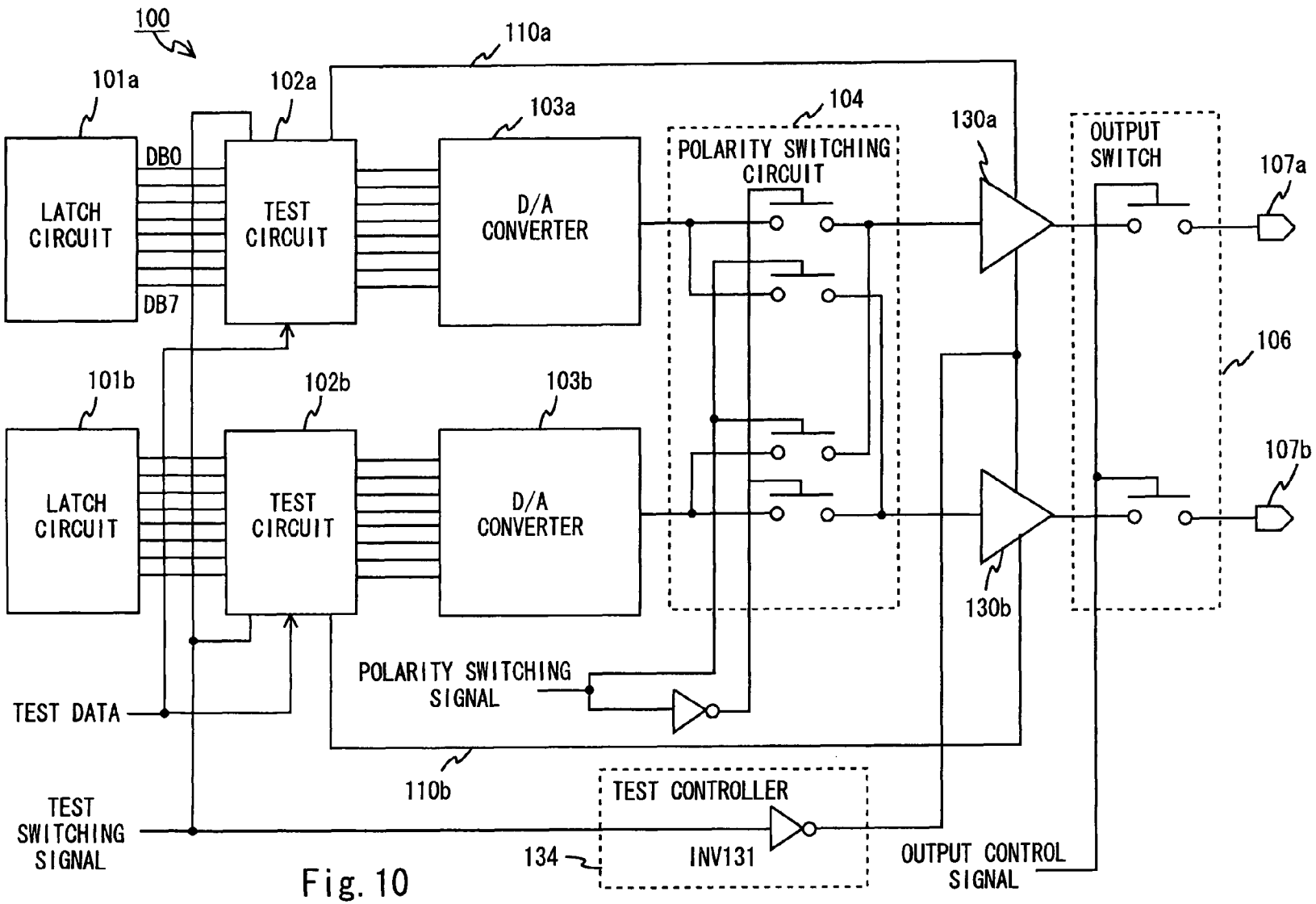
FIG. 10 shows an example of a configuration of a driver of a display unit according to a third embodiment of the present invention.

The driver of the display unit according to the third embodiment of the present invention will be described with reference to FIG. 10. FIG. 10 shows an example of a configuration of the driver of the display unit according to the third embodiment. The configurations to which the same symbols are given as in FIGS. 1 and 8 indicate same or similar configurations as those in FIGS. 1 and 8. The specific configuration and the description of the behavior of the test circuit 102 are the same as well. The difference between the second embodiment and the third embodiment is that the circuit of the output stage of the output amplifier is configured as the output buffer of the test signal in the third embodiment. There is a difference in the configurations of the output amplifier 130 and the test controller 134. However, the third embodiment is effective only when the test signal of the test circuit 102 is output signal.

The test controller 134 connects the test signal line 110 to the output stage of the output amplifier 130 when the test switching signal is in high level (test operation). Therefore, the test controller 134 is formed by an inverter INV 131 inverting the test switching signal.

Figure 11:
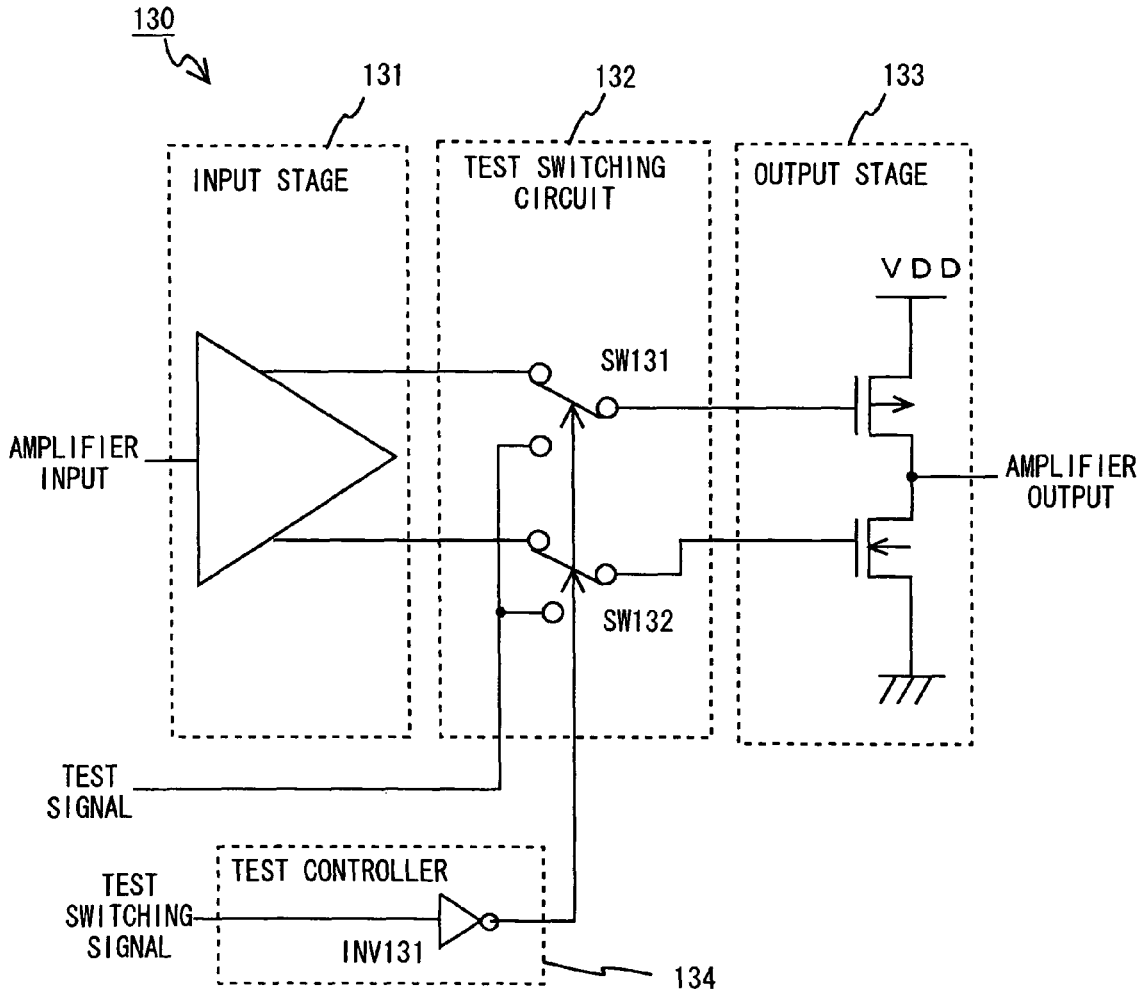
FIG. 11 shows an example of a configuration of an output amplifier of the display unit according to the third embodiment of the present invention.

FIG. 11 shows an example of the amplifier 130 according to the third embodiment. In FIG. 11, the amplifier 130 includes an input stage 131, a test switching circuit 132, and an output stage 133. The input stage 131 and the output stage 133 have the same configurations as those of the input stage 121 and the output stage 123 shown in the second embodiment and therefore the description thereof is omitted.

The test switching circuit 132 includes switches SW131 and SW132. The switches SW131 and SW132 switch the test signal and the signal output from the input stage 131 according to the signal obtained by inverting the test switching signal by the inverter INV 131. The switch SW131 is connected to the output side of the input stage 131 when the test switching signal is in low level (normal operation). The switch SW131 is connected to the test signal line 110 side when the test switching signal is in high level (test operation). Similarly, the switch SW132 is connected to the output side of the input stage 131 when the test switching signal is in low level (normal operation). The switch SW132 is connected to the test signal line 110 side when the test switching signal is in high level (test operation).

Next, the behavior of the driver of the display unit according to the third embodiment will be described. However, configurations other than the test switching circuit 132 forming the amplifier 130 are the same as those in the second embodiment. Therefore, the overlapping description is omitted. The behavior in the normal operation is the same as that in the second embodiment as well, and therefore the overlapping description is omitted.

In test operation, the test switching signal is in high level and the signal output from the test controller 134 is in low level. Therefore, the switch SW131 of the test switching circuit 132 is connected to the test signal line 110 side. Similarly, the switch SW132 is connected to the test signal line 110 side as well. Therefore, the output stage 133 functions as the logic output buffer outputting the test signal, and the signal is output to the amplifier output terminal with predetermined driving ability.

Therefore, in the driver according to the third embodiment of the present invention, it is possible to connect the test signal and the output pin 107 in the test operation. In the normal operation, the relationship between the output amplifier 130 and the output pin 107 is equivalent to the configuration without the test circuit 102. Therefore, there is no problem that the output impedance is increased. Further, the test signal is output through strong logic output buffer configured by the output stage 133 of the output amplifier 130. Therefore, since there is no test switch having impedance as the driver in the first and second embodiments, it is possible to output high-speed test signal in the test operation. Hence, the test time can be reduced.

Fourth Embodiment

Figure 12:
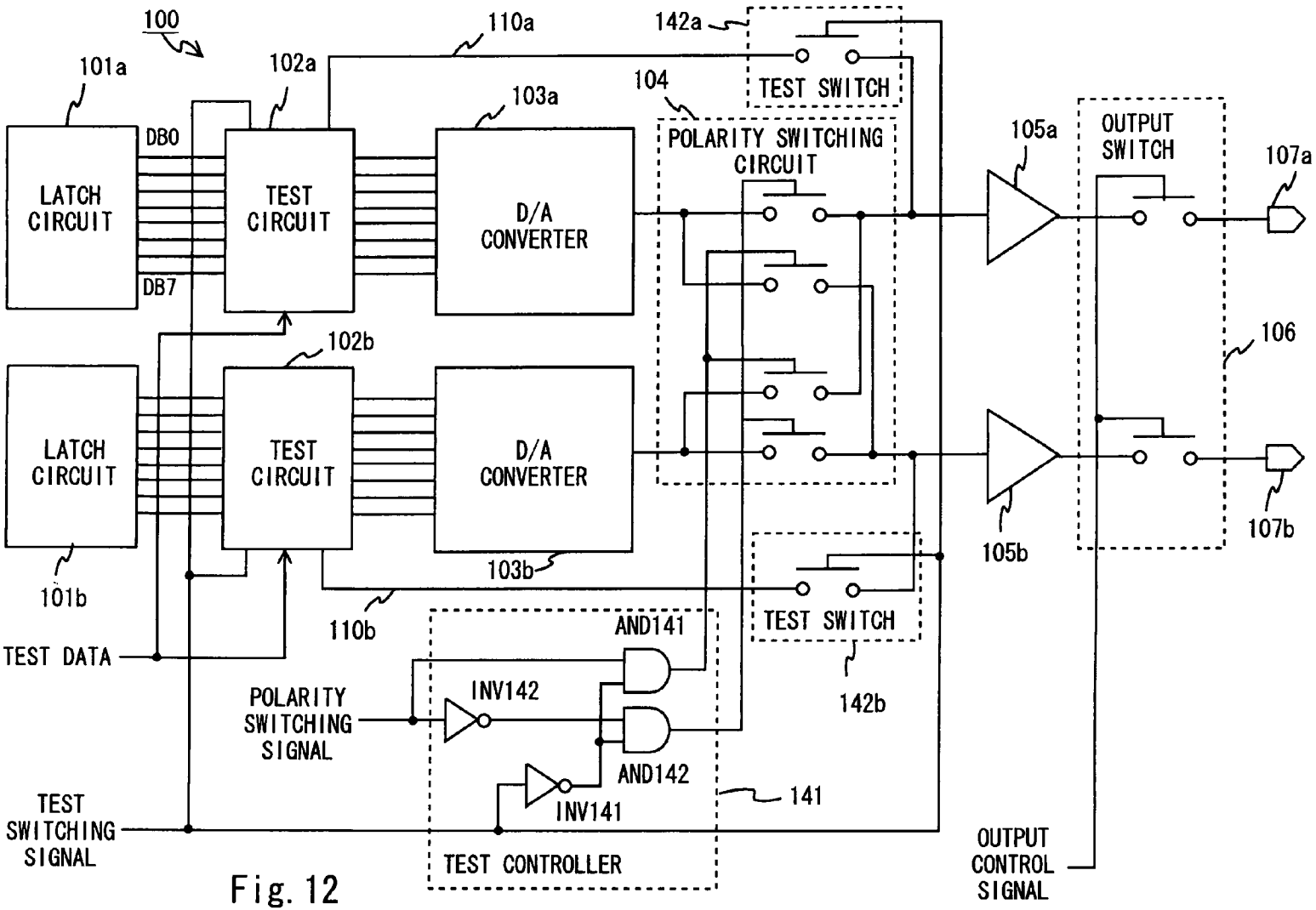
FIG. 12 shows an example of a configuration of a driver of a display unit according to a fourth embodiment of the present invention.
Figure 13:
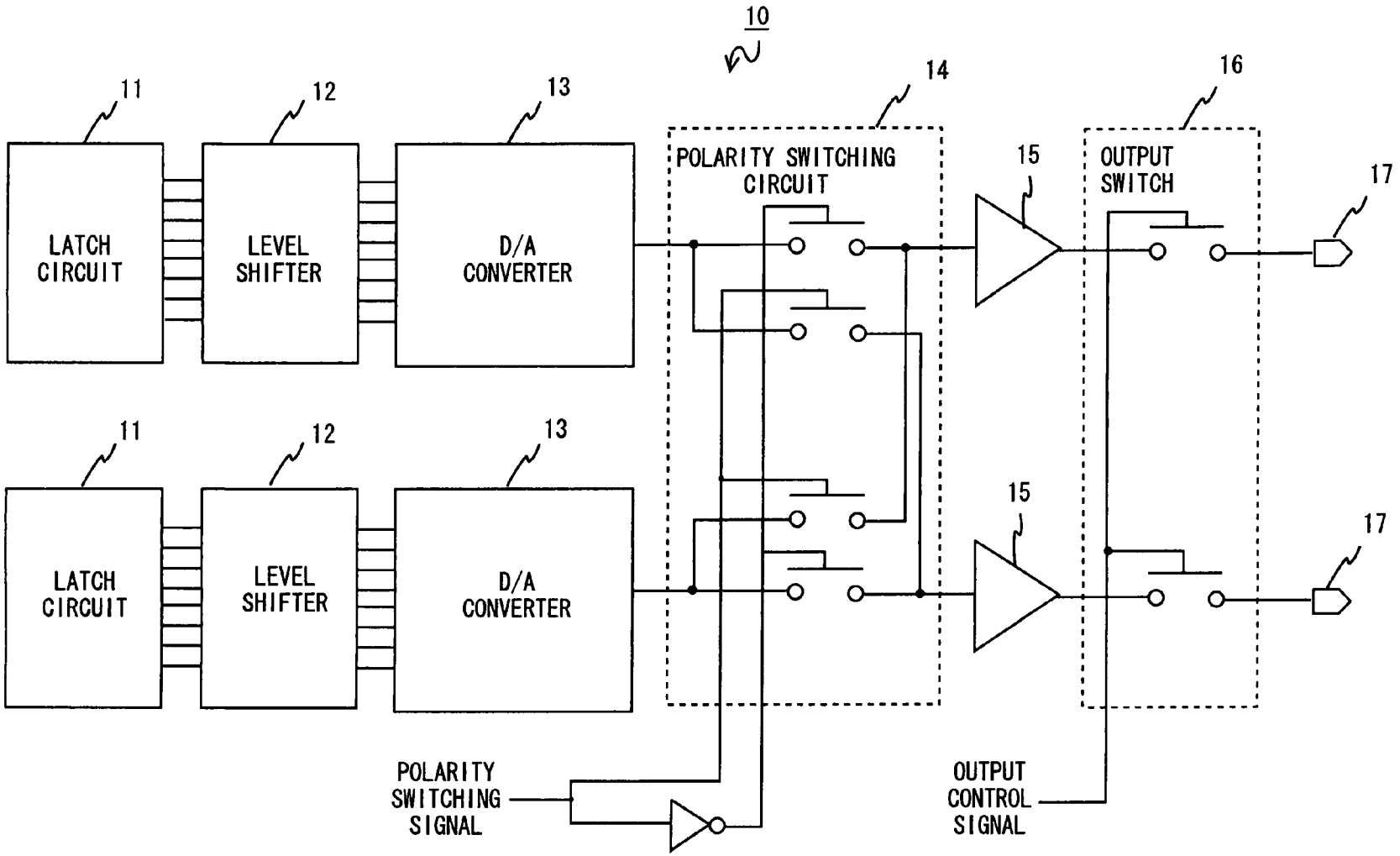
FIG. 13 shows an example of a configuration of a driver of a display unit according to a related art.

Now, the driver of the display unit according to the fourth embodiment of the present invention will be described with reference to FIG. 12. FIG. 12 shows an example of a configuration of the driver of the display unit according to the fourth embodiment. The configurations to which the same symbols are given as in FIG. 1 indicate the same or similar configurations as those in FIG. 1. The specific configuration and the description of the behavior of the test circuit 102 are the same as well. The difference between the first embodiment and the fourth embodiment is that the switch is forced to be disconnected in test operation when there is provided a switch circuit (polarity switching circuit 104 in this example) between the D/A converter 103 and the output amplifier 105. Therefore, the configurations of the test controller 141 and the test switch 142 are different from those in the first embodiment. However, the fourth embodiment is effective only when the test signal of the test circuit is output signal.

The test controller 141 turns off the polarity switching circuit (the control signal of the polarity switching circuit is in low level) when the test switching signal is in high level (test operation). Therefore, the test controller 141 includes an inverter INV 141, an inverter INV 142, an AND circuit AND 141, and an AND circuit AND 142. The inverter INV 141 inverts the test switching signal, and the inverter INV 142 inverts the polarity switching signal. The AND circuit AND 141 outputs the output signal of the inverter INV 142 and the polarity switching signal to the polarity switching circuit as input signals, and the AND circuit AND 142 outputs the output signal of the inverter INV 141 and the output signal of the inverter INV 142 to the polarity switching circuit as the input signals.

The test switch 142 connects the test signal line 110 to the input of the output amplifier 105 when the test switching signal is in high level (test operation).

Now, the behavior of the driver of the display unit according to the fourth embodiment will be described. When the test switching signal is in low level (normal operation), the high level signal inverted by the inverter INV 141 is input to the AND circuits AND 141 and AND 142. Therefore, the polarity switching signal and the signal obtained by inverting the polarity switching signal are directly output from the test controller 141 and the behavior is the same as that in the related art. Similarly, the test switch 142 is turned off and the test signal line 110 and the input of the output amplifier 105 are disconnected with each other.

On the other hand, in the test controller 141, the low level signal inverted by the inverter INV 141 is input to the AND circuits AND 141 and AND 142 when the test switching signal is in high level (test operation). Therefore, the AND circuits AND 141 and AND 142 both output the low level signals, and all the polarity inverting switch 104 are in disconnection state. At the same time, the test switch 142 is in ON state and therefore the test signal line 110 and the input of the output amplifier 105 are connected. Therefore, the test signal is output to the output pin 107 with predetermined driving ability by the output amplifier 105.

Therefore, since the relationship between the output amplifier 105 and the output pin 107 is equivalent to the configuration without the test circuit in normal operation, there is not caused a problem that the output impedance is increased. Further, the test signal is also output through the output amplifier. Therefore, there is no test switch having impedance between the test signal and the output pin as the driver in the first embodiment and the second embodiment. Therefore, it is possible to output the high-speed test signal in the test operation, which makes it possible to reduce test time.

It is apparent that the present invention is not limited to the above embodiments, but may be modified and changed without departing from the scope and spirit of the invention. For example, the driver may be applied to an organic light emitting display, a plasma display, an SED or the like.

What is claimed is:

1. A driver of a display unit, said driver comprising:

a latch circuit holding gradation information;

a D/A converter outputting an analog signal based on the gradation information held by the latch circuit;

a test circuit provided between the latch circuit and the D/A converter, the test circuit inputting or outputting a test signal regarding the latch circuit;

a switch connecting a positive voltage output of the D/A converter and a first driver output terminal and connecting a negative voltage output and a second driver output terminal in a normal operation; and a test switch feeding back the first driver output terminal and the second driver output terminal to the test circuit in a test operation and disconnecting the test circuit and the first driver output terminal and the second driver output terminal in said normal operation.

2. The driver of the display unit according to claim 1, further comprising an amplifier amplifying the analog signal, wherein the switch sets an output stage in said test operation to a deactivation state.

3. The driver of the display unit according to claim 1, further comprising an amplifier amplifying the analog signal, wherein the test switch applies the test signal to an output stage of the amplifier in said test operation.

4. The driver of the display unit according to claim 1, wherein the switch comprises a switching circuit outputting a positive voltage output of the D/A converter to a first driver output terminal and outputting a negative voltage output of the D/A converter to a second driver output terminal.

5. The driver of the display unit according to claim 1, wherein the test circuit detects a match or a mismatch between sets of data.

6. The driver of the display unit according to claim 1, wherein the test circuit is connected to a test signal line, wherein the test signal comprises a low-level signal during said normal operation, and wherein the test signal comprises a high-level signal during said test operation.

7. The driver of the display unit according to claim 1, wherein the test circuit comprises a plurality of switches and said plurality of switches is controlled by test data.

8. The driver of the display unit according to claim 7, wherein the plurality of switches comprises a first-stage switch, a second-stage switch, and a third-stage switch.

9. The driver of the display unit according to claim 1, wherein said normal operation comprises an output driving period and a panel charge collecting period.

10. The driver of the display unit according to claim 8, wherein when the test data is in a low level, a first input terminal input terminals of the first-stage switch is connected to an output terminal of the first stage switch, and when the test data is in a high level, a second input terminal of the first-stage switch is connected to the output terminal of the first-stage switch.

* * * * *